US008270864B2

(12) United States Patent
Takesada

(10) Patent No.: US 8,270,864 B2
(45) Date of Patent: Sep. 18, 2012

(54) IMAGE FORMING APPARATUS FOR MANAGING BILLING DESTINATION

(75) Inventor: Yoshikazu Takesada, Kawabe-gun (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 607 days.

(21) Appl. No.: 12/336,971

(22) Filed: Dec. 17, 2008

(65) Prior Publication Data

US 2009/0257771 A1 Oct. 15, 2009

(30) Foreign Application Priority Data

Apr. 15, 2008 (JP) ..... 2008-105915

(51) Int. Cl.
*G03G 21/02* (2006.01)

(52) U.S. Cl. ..... 399/79

(58) Field of Classification Search ..... 399/8, 79, 399/80; 705/30, 34, 52, 400
See application file for complete search history.

(56) References Cited

U.S. PATENT DOCUMENTS

| | | | | |
|---|---|---|---|---|
| 5,903,801 | A * | 5/1999 | Nakamura | 399/79 |
| 6,178,298 | B1 * | 1/2001 | Nagatani | 399/79 |
| 6,216,113 | B1 * | 4/2001 | Aikens et al. | 705/34 |
| 6,545,767 | B1 * | 4/2003 | Kuroyanagi | 358/1.14 |
| 6,798,532 | B1 | 9/2004 | Okino | |
| 7,558,500 | B2 * | 7/2009 | Shibata | 399/79 |
| 7,571,126 | B2 * | 8/2009 | Nguyen et al. | 705/30 |
| 7,715,030 | B2 * | 5/2010 | Higashiura et al. | 358/1.14 |
| 7,760,382 | B2 * | 7/2010 | Murata | 358/1.15 |
| 2002/0062453 | A1 * | 5/2002 | Koga | 713/202 |

FOREIGN PATENT DOCUMENTS

| | | |
|---|---|---|
| JP | 2002-108753 | 4/2002 |
| JP | 2002-247329 | 8/2002 |
| JP | 2002-351624 A | 12/2002 |
| JP | 2004-054490 | 2/2004 |
| JP | 2007-280114 | 10/2007 |

OTHER PUBLICATIONS

Notice of Grounds of Rejection issued in the corresponding Japanese Patent Application No. 2008-105915 dated Feb. 9, 2010, and an English Translation thereof.

* cited by examiner

*Primary Examiner* — Robert Beatty
(74) *Attorney, Agent, or Firm* — Buchanan Ingersoll & Rooney PC

(57) ABSTRACT

Upon registration of such document data that a general affairs department issues a request to print out the document data to a sales department, the document data is registered in a billing management box designated as a registration destination in an MFP allocated to the sales department. The MFP adds a department ID of the general affairs department which is authentication information at this operation, as billing destination information, to the document data. When the general affairs department sets an upper limit of printout of the print data, an upper limit value counter is added to the document data. When the general affairs department issues a request of notification, a fact that the document data is registered is displayed on a panel of the MFP allocated to the sales department; thus, the sales department receives the notification.

19 Claims, 9 Drawing Sheets

IMAGE FORMING APPARATUS FOR MANAGING BILLING DESTINATION

This application is based on Japanese Patent Application No. 2008-105915 filed with the Japan Patent Office on Apr. 15, 2008, the entire content of which is hereby incorporated by reference.

BACKGROUND OF THE INVENTION

1. Field of the Invention

The present invention relates to an image forming apparatus, and a billing management method in the image forming apparatus. In particular, the present invention relates to an image forming apparatus capable of managing a place to which billing for image formation is issued, and a billing management method in the image forming apparatus.

2. Description of the Related Art

In an office and the like, occasionally, image forming apparatuses, such as copying machines, printers, and complex machines thereof, that is, MFPs (Multi Function Peripherals), connected to a network have been allocated to departments such as a sales department and a general affairs department, respectively. In such a usage, typically, a state of usage is grasped for each image forming apparatus, and billing is issued to the department to which the relevant image forming apparatus is allocated.

However, this billing management method has the following problem. For example, in a case where a first department such as a general affairs department creates document data and, then, issues a request of image formation (e.g., printing) to a second department such as a sales department, if an image forming apparatus allocated to the second department is used for printing out the document data, billing is typically issued to the second department. Consequently, this method lacks fairness.

In order to solve this problem, for example, Japanese Laid-Open Patent Publication No. 2002-351624 (hereinafter, referred to as Document 1) discloses a technique of adding information about designation of a billing destination to document data prior to distribution of the document data from a department (general affairs department) that issues a request of image formation.

By adoption of the technique disclosed in Document 1, billing can be issued to the general affairs department even in the case where the document data is printed out by the image forming apparatus in the sales department. In the general affairs department, however, each time document data is created, information for designation of a billing destination must be added to the document data. Consequently, there is a problem that an operation at the time of issuing the request becomes complicated. Further, there is a problem that even in the case where the information for designating the billing destination as the general affairs department is added to the document data, if the document data is printed out in the sales department on condition which has not been desired by the general affairs department (e.g., the number of sheets of paper to be printed, a paper size), billing for such printing operations is also issued to the general affairs department.

SUMMARY OF THE INVENTION

The present invention has been devised in view of the problems described above. An object of the present invention is to provide an image forming apparatus that allows a side issuing a request to print out document data to appropriately manage billing for the printout with a simple operation, and a billing management method in the image forming apparatus.

In order to achieve this object, according to one aspect of the present invention, an image forming apparatus includes an input unit for document data, a registration unit registering the document data in a predetermined memory area, a print unit printing out the document data stored in the predetermined memory area, and a request unit issuing a request of billing to a specific department for the printout of the document data registered in the memory area, to a billing managing apparatus that manages billing for printout in each department.

According to another aspect of the present invention, a billing management method in an image forming apparatus includes an acceptance step of accepting a command to print out document data correlated with a department and stored in a predetermined memory area, a print step of printing out the document data, and a request step of issuing a request of billing to a specific department designated as a place to which billing for the printout of the document data is issued.

According to still another aspect of the present invention, a billing management method in an image forming apparatus includes an acceptance step of accepting a command to register document data in a predetermined memory area, an authentication step of authenticating a department that issues the command, and a registration step of setting information indicating the department as a place to which billing for printout is issued at the document data, and registering the document data in the memory area.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

With reference to the drawings, hereinafter, description will be given of preferred embodiments of the present invention. In the following description, identical components and constituent elements are denoted by identical reference symbols. Designations and functions thereof are also the same.

Figure 1:
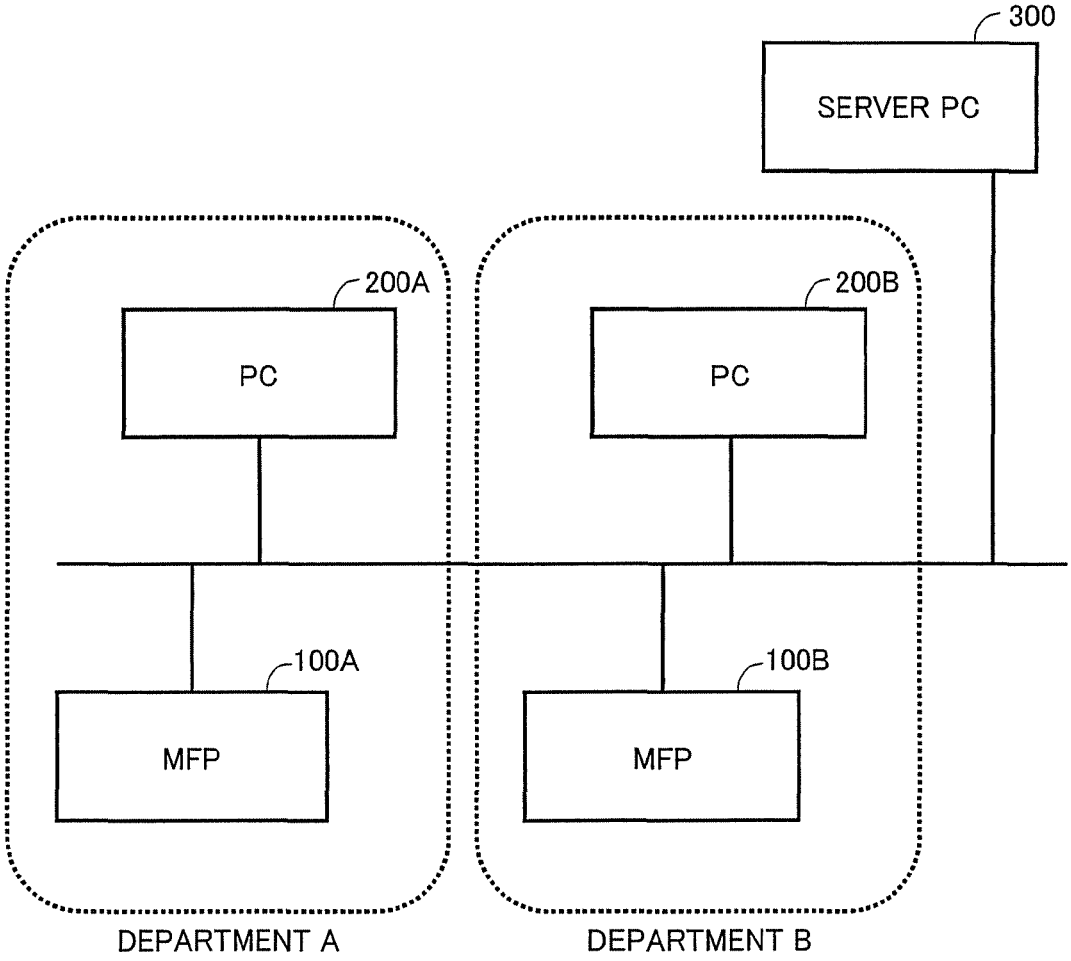
FIG. 1 shows a specific example of a system configuration according to an embodiment.

It is assumed herein that a system configuration according to the present embodiment is a system configuration in an office environment, for example. With reference to FIG. 1, in the system according to the present embodiment, MFPs (Multi Function Peripherals) 100A and 100B each of which is a specific example of an image forming apparatus, personal computers (hereinafter, abbreviated as PCs) 200A and 200B each of which serves as an information processing apparatus, and a server PC 300 which serves as a managing apparatus are connected to one another through a network. It is assumed herein that MFP 100A and PC 200A are allocated to a department A and are owned by department A while MFP 100B and PC 200B are allocated to a department B and are owned by department B. In the following description using a specific example, it is assumed that department A is a department in a position exercising control over other departments and department B is a department in a position subjected to the control. Department A which is a department in a position exercising control over other departments corresponds to, for example, a general affairs department while department B which is a department in a position subjected to the control corresponds to, for example, a sales department.

Figure 2:
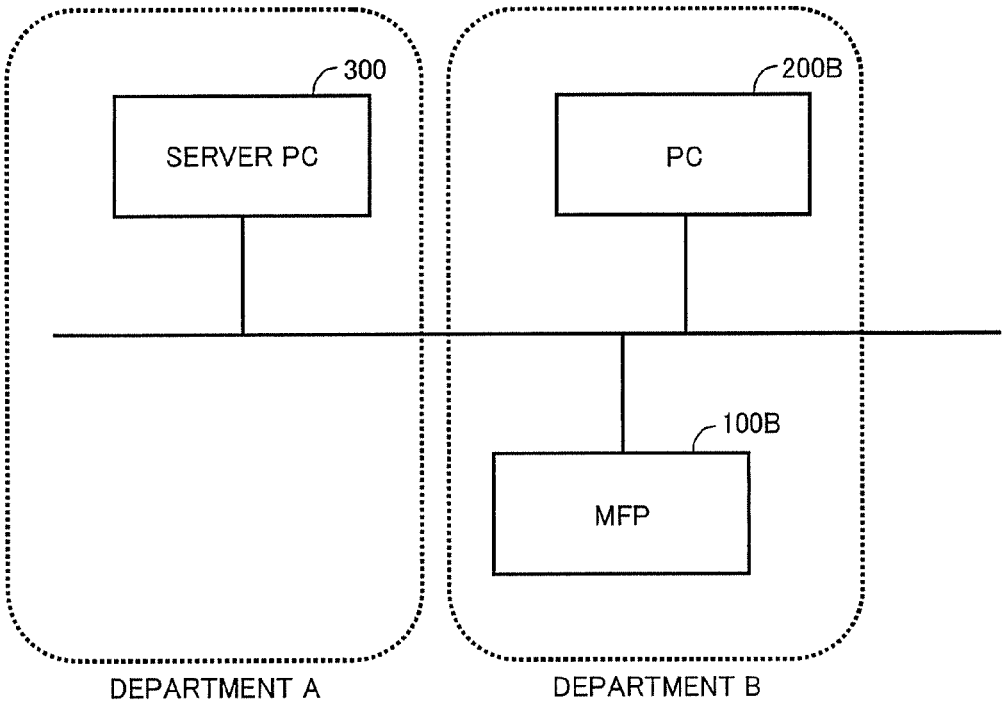
FIG. 2 shows another specific example of the system configuration according to the embodiment.

Server PC 300 manages states of usage of MFPs 100A and 100B. In the specific example shown in FIG. 1, server PC 300 is included in addition to PCs 200A and 200B. As shown in FIG. 2, however, the configuration may be such that server PC 300 additionally functions as one of PCs 200A and 200B, for example, PC 200A, that is, PC 200A is not included. Conversely, the configuration may be such that server PC 300 is not included. As shown in FIG. 2, it is sufficient in the system configuration that at least one image forming apparatus is included. For example, the configuration may be such that only MFP 100B is included, but MFP 100A is not included.

It is assumed that each of PCs 200A and 200B is a typical PC. That is, it is assumed that each of PCs 200A and 200B has a hardware configuration similar to that of a typical PC.

In this specific example, it is assumed that MFPs 100A and 100B are equal in configuration and, therefore, will be collectively referred to as MFP 100.

Figure 3:
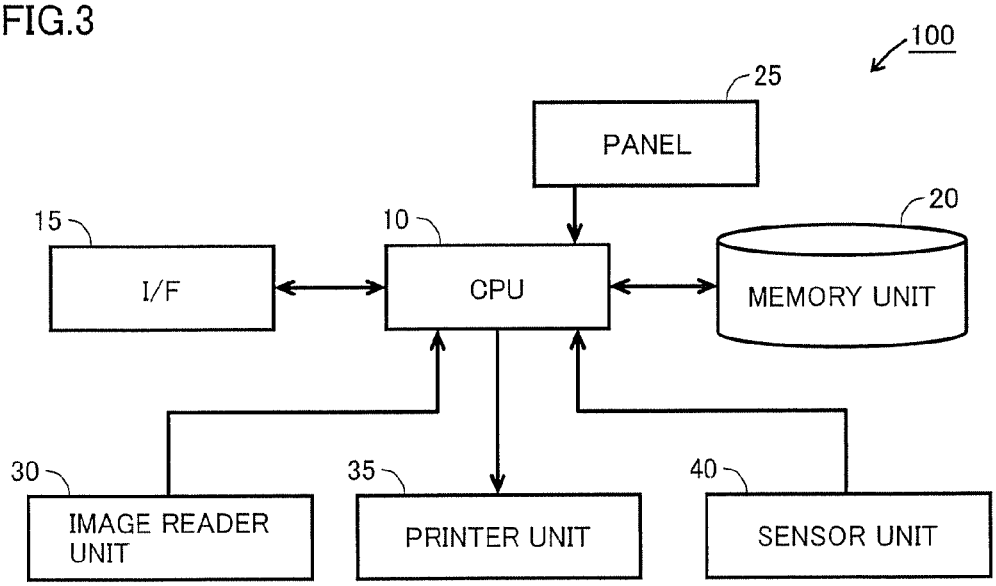
FIG. 3 is a block diagram showing a specific example of a hardware configuration of an MFP according to the embodiment.

With reference to FIG. 3, MFP 100 is configured to include a CPU (Central Processing Unit) 10, an image reader unit 30, a printer unit 35, an interface (hereinafter, abbreviated as I/F) 15, a memory unit 20, a panel 25 and a sensor unit 40.

CPU 10 controls the whole of the apparatus. Image reader unit 30 reads image data from an original. Printer unit 35 outputs an image onto a sheet of paper. I/F 15 is an interface for connecting MFP 100 to a network telephone line or for establishing short-range wireless communications. Panel 25 serves as a unit displaying various kinds of information, and also serves as a command input unit. Sensor unit 40 detects a remaining quantity of a consumable component, and the like.

Memory unit 20 includes an HD (Hard Disk) and the like, and stores document data, information about relevant MFP 100, a program executed by CPU 10, and the like. Memory unit 20 also includes memory areas which are provided while being correlated with users or departments to store the document data. In the following description, these memory areas are referred to as boxes.

The boxes of MFP 100 include a billing management box as a box according to the present invention. In the following description, it is assumed that department A issues a request to output document data to department B. In this case, the document data is registered in the billing management box in MFP 100B allocated to department B, on the basis of a command from PC 200A allocated to department A, in the present embodiment. Then, the document data registered in the billing management box in MFP 100B is outputted in MFP 100B allocated to department B, so that billing management according to the present invention is implemented.

Figure 4:
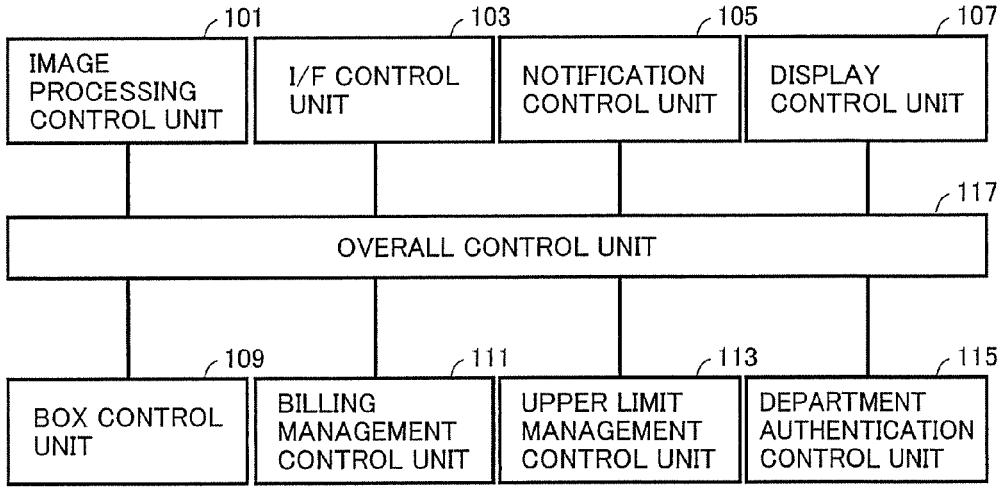
FIG. 4 is a block diagram showing a specific example of a control configuration of the MFP according to the embodiment.

A control configuration of MFP 100 shown in FIG. 4 is a control function which is principally formed in CPU 10 in such a manner that CPU 10 reads and executes a program stored in memory unit 20. However, the control configuration may partly include the hardware configuration shown in FIG. 3.

With reference to FIG. 4, the control configuration of MFP 100 includes an image processing control unit 101, an I/F control unit 103, a notification control unit 105, a display control unit 107, a box control unit 109, a billing management control unit 111, an upper limit management control unit 113, a department authentication control unit 115 and an overall control unit 117.

Image processing control unit 101 controls a process for image data received by CPU 10. I/F control unit 103 controls input/output of data in I/F 15 to/from, principally, the network. Notification control unit 105 controls a notifying process (to be described later) in CPU 10. Display control unit 107 controls a displaying process in panel 25. Upper limit control unit 113 performs control for restricting the number of sheets of paper to be printed in accordance with a setting value which has been set in advance. Department authentication control unit 115 controls an authenticating process for authenticating a department to which a user who logs in to MFP 100 belongs. Overall control unit 117 performs overall control.

Box control unit 109 controls storage of document data in a box. Specifically, box control unit 109 is configured to include a predetermined area of memory unit 20, and stores information about the respective boxes, which include the billing management box, set at memory unit 20. With regard to all the boxes, the information about the box contains at least information for specifying a user or a department with which the relevant box is correlated. With regard to the billing management box, the information about the box contains an identifier indicating that the relevant box is the billing management box.

Billing management control unit 111 performs control for managing billing in accordance with the number of printed sheets of paper in CPU 10. Specifically, billing management control unit 111 is configured to include a predetermined area of memory unit 20 to store a billing counter for counting a sum of money to be charged to relevant MFP 100. In the present embodiment, it is assumed that billing is issued in accordance with the number of printed sheets of paper. In other words, it is assumed that a predetermined amount of money per one sheet of paper is charged to MFP 100. Therefore, it is assumed that the billing counter counts a sum of money charged to relevant MFP 100 or the number of printed sheets of paper corresponding to the sum of money. The billing counter may be decremented from a preset upper limit value so as to reach zero in accordance with the number of sheets of paper to be printed or may be incremented from zero in accordance with the number of sheets of paper to be printed. To issue billing to relevant MFP 100 itself indicates that billing management control unit 111 increments the billing counter stored therein in accordance with the number of sheets of paper to be printed. To issue billing to another MFP 100 indicates that billing management control unit 111 issues a request to increment the billing counter stored in billing management control unit 111 of relevant another MFP 100, to relevant another MFP 100. It is to be noted that the method of managing the billing with the use of the billing counter is one specific example of billing management; therefore, the billing management according to the present invention is not limited to the method described above.

Billing management control unit 111 also stores departments with which MFPs 100 included in this system are correlated, respectively. It is assumed herein that billing management control unit 111 stores identifiers (hereinafter, referred to as department IDs) indicating the department as information for specifying the departments with which MFPs 100 included in this system are correlated, respectively.

Figure 5:
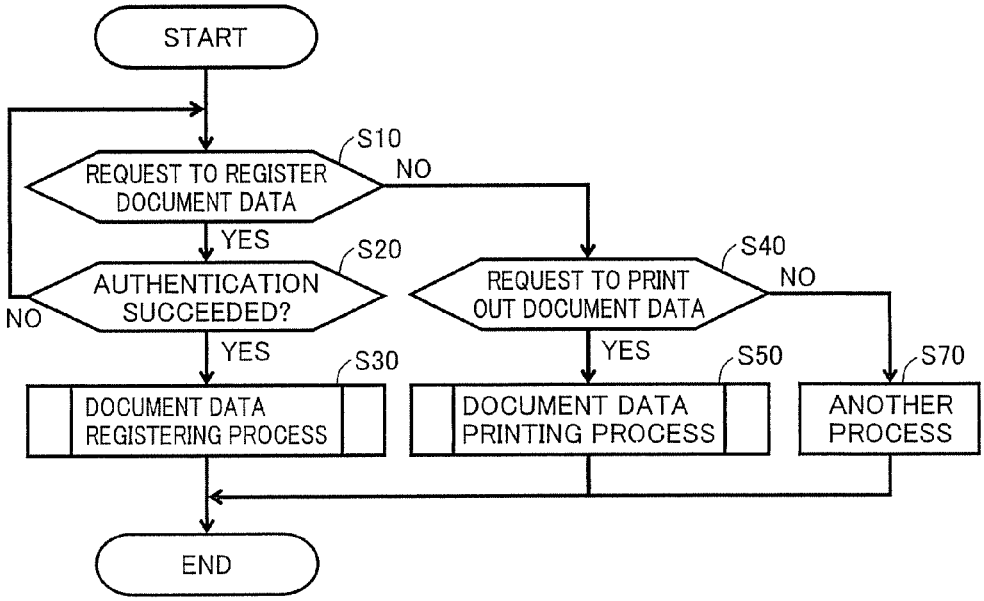
FIG. 5 is a flowchart showing a specific example of a flow of processes in the MFP according to the embodiment.

A flow of the processes in MFP 100, shown in a flowchart of FIG. 5, is started when CPU 10 of MFP 100 accepts input of a command signal from panel 25 or the like. CPU 10 of MFP 100 reads and executes the program stored in memory unit 20 in accordance with the command signal, and the respective control units shown in FIG. 4 perform control, respectively, so that the processes shown in the flowchart of FIG. 5 are realized.

With reference to FIG. 5, when CPU 10 accepts input of a command signal from panel 25 or the like, then, overall control unit 117 analyzes the command signal, and executes a process of determining whether or not the command signal contains a command of a request to register document data in a box or a process of determining whether or not the command signal contains a command of a request to print out document data registered in a box (steps S10, S40).

If overall control unit 117 determines that the accepted command signal contains the command of the request to register the document data in the box (YES in step S10), then, department authentication control unit 115 performs screen display and the like in order to issue a request of authentication to a command source such as panel 25 or PC 200, and issues a request to receive authentication information. It is assumed herein that the authentication information is a department ID of a department to which a user of the command source belongs. Department authentication control unit 115 allows an authentication part (not shown) in MFP 100 or an authenticating apparatus (now shown) included in the system configuration to execute an authenticating process of authenticating whether or not the department of the command source is a department permitted in advance with the use of the received department ID, and obtains a result of the authentication. If the authentication result is succeeded (YES in step S20), then, box control unit 109 or the like executes a document data registering process of registering designated document data in a designated box (to be described later) (step S30). If the authentication result is failed (NO in step S20), then, the routine returns to step S10 without execution of the registering process in step S30. Alternatively, department authentication control unit 115 may execute the authenticating process again.

If the received command signal contains the command of the request to print out the document data registered in the box (NO in step S10 and YES in step S40), then, image processing control unit 101 or the like executes a document data printing process of printing out designated document data (to be described later) (step S50).

If the received command signal is neither the command of the request to register the document data in the box nor the command of the request to print out the document data registered in the box (NO in step S10 and NO in step S40), then, another process is executed in accordance with the command (step S70). The process in step S70 is not limited to a specific process in the present invention.

First Embodiment

Figure 6:
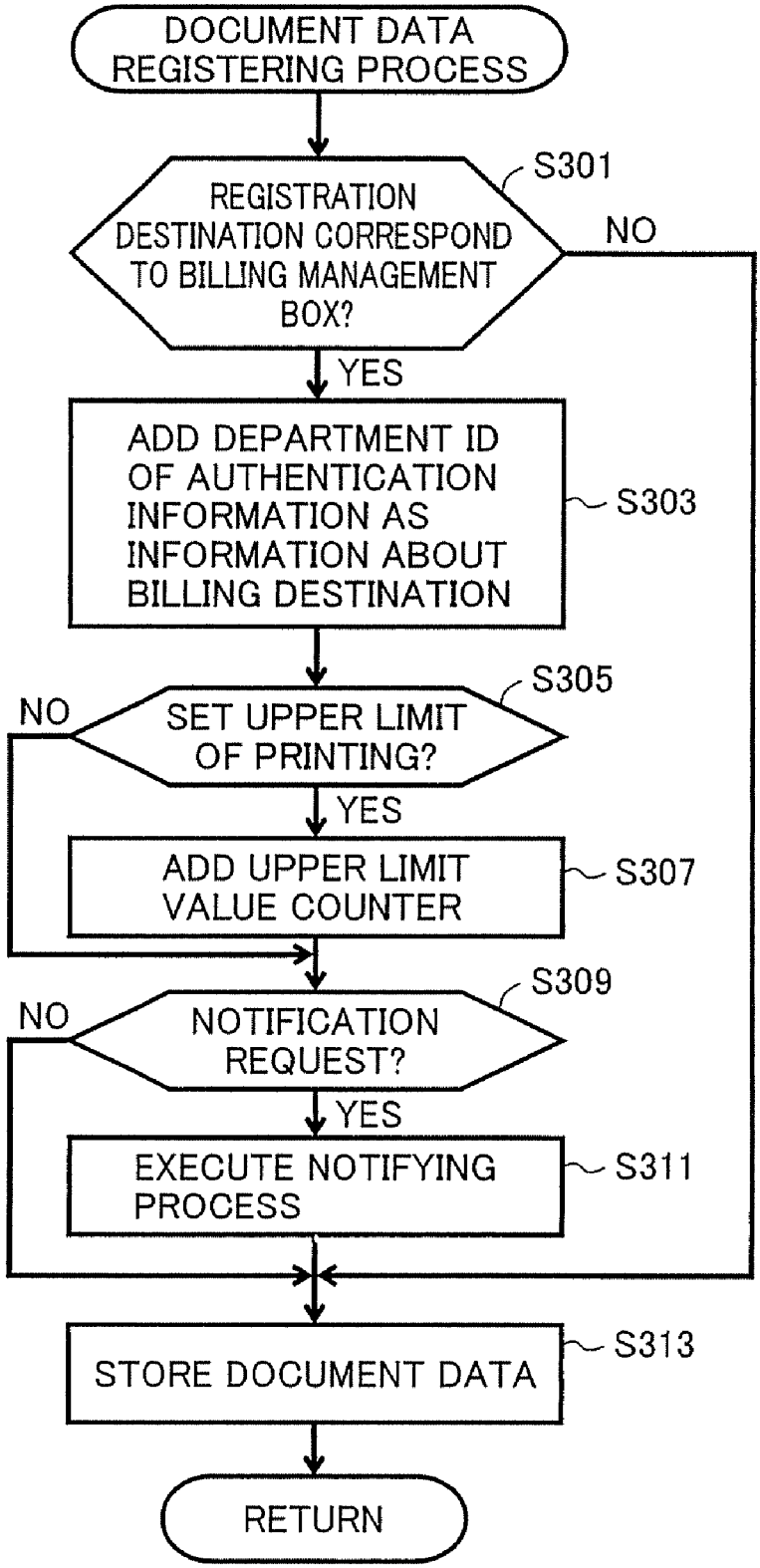
FIG. 6 is a flowchart showing a specific example of a document data registering process according to a first embodiment.

FIG. 6 is a flowchart showing a specific example of the document data registering process in step S30 according to a first embodiment. Specifically, it is assumed herein that one of MFP 100A and PC 200A allocated to department A or MFP 100B allocated to department B is operated, so that document data is registered in the box in MFP 100B.

With reference to FIG. 6, first, box control unit 109 of MFP 100B analyzes a command signal received newly, and determines whether or not a box designated as a document data registration destination is the billing management box described above (step S301). In a case where PC 200A issues the command to register the document data, for example, such a command is issued by operations including an operation of moving an icon representing the document data to be registered toward an icon representing the box serving as a registration destination in a drag-and-drop manner, and the like. On the other hand, in a case where MFP 100A or MFP 100B issues the command to register the document data, such a command is issued by operations including an operation of depressing a button representing the box serving as a registration destination displayed on panel 25, and the like. As described earlier, in the case where, with regard to the information about the box, the relevant box corresponds to the billing management box, the box control unit 109 stores the identifier indicating the fact that the relevant box is the billing management box. In step S301, therefore, box control unit 109 determines whether or not the identifier described above is stored as the information about the box to determine whether or not the designated box is the billing management box described above, with regard to the box as the registration destination indicated by the received command signal.

If box control unit 109 determines that the billing management box is designated as the registration destination (YES in step S301), then, box control unit 109 acquires the department ID of department A, which is the authentication information used for the authentication in step S20, from department authentication control unit 115, and adds the department ID to the document data as the place to which billing for printout of the document data is issued (step S303). That is, in the registering process according to the first embodiment, department A, which is the department of the user who has registered the document data, is set at the document data as the billing destination. The information which is added to the document data and specifies the place to which the billing for printout of the document data is issued is referred to as "billing destination information".

Upper limit management control unit 113 analyzes a command signal received newly, and determines whether or not the command signal contains a setting of an upper limit value (the upper limit number of sheets of paper to be printed) at the time when the document data is printed out (step S305). It is assumed that the operation of setting the upper limit value (the upper limit number of sheets of paper to be printed) at the time when the document data is printed out is performed simultaneously with the command to register the document data or subsequent to the command. Moreover, it is assumed that the operation is performed by the user who registers the document data through PC 200A, panel 25 of one of MFPs 100A and 100B, or the like.

If upper limit management control unit 113 determines that the upper limit value (the upper limit number of sheets of paper to be printed) at the time when the document data to be registered is printed out is set (YES in step S305), then, upper limit management control unit 113 sets the upper limit value counter described above in accordance with the set upper limit number of sheets of paper to be printed, and adds the upper limit value counter to the document data (step S307).

Notification control unit 105 analyzes the received command signal, and determines whether or not the command signal contains a command of a request to notify a predetermined counterpart of the registration of the document data (step S309). It is assumed that this request is also performed simultaneously with the command to register the document data or subsequent to the command. Moreover, it is assumed that the request is made by the user who registers the document data through PC 200A, panel 25 of one of MFPs 100A and 100B, or the like.

Figure 7:
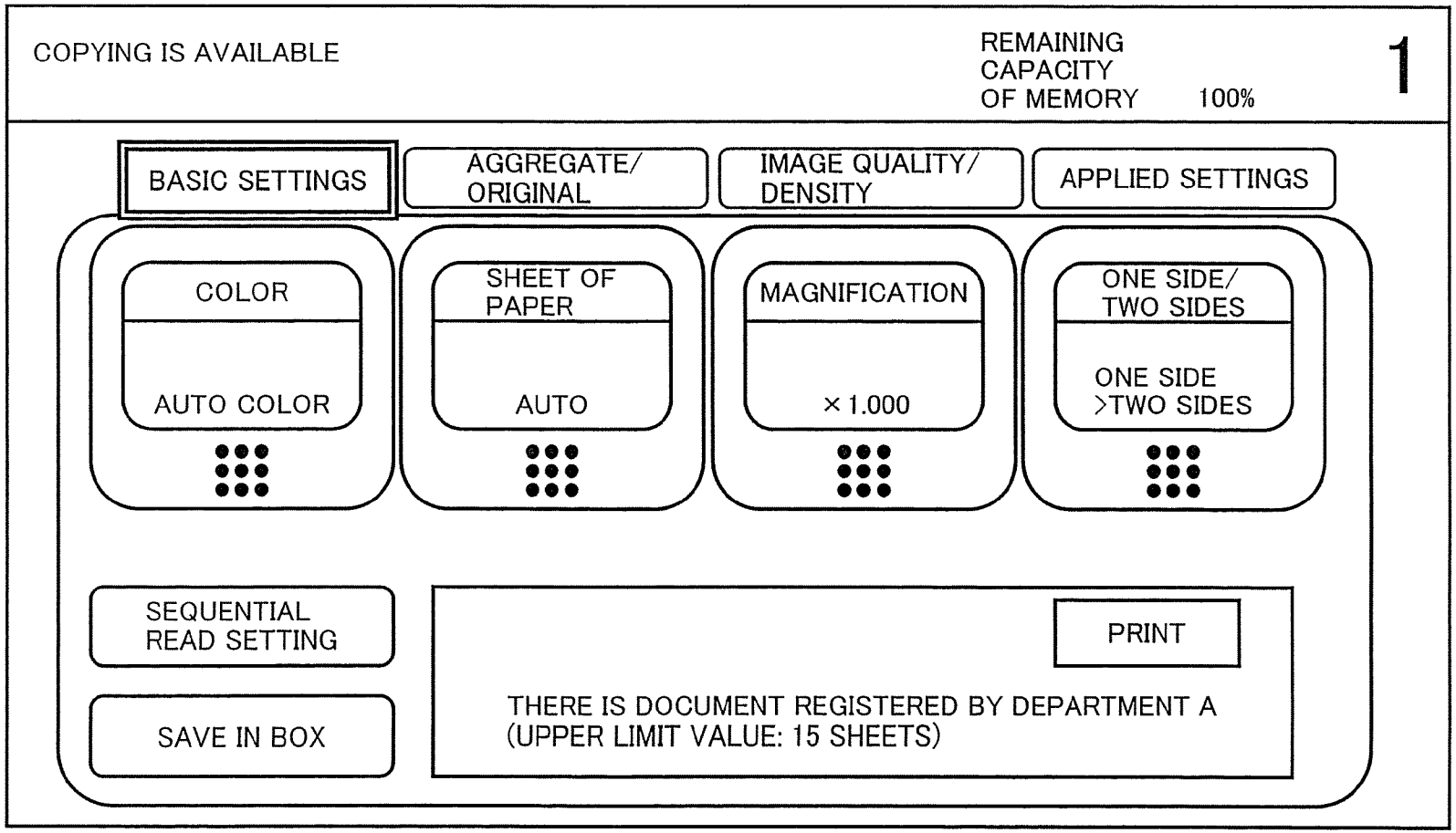
FIG. 7 shows a specific example of a notification screen in the MFP.

If notification control unit 105 determines that there is the request to notify the predetermined counterpart of the registration of the document data (YES in step S309), then, notification control unit 105 executes the notifying process, which is a process for notification of the registration of the document data to the billing management box of MFP 100B, by a prescribed method such as a method of sending an e-mail message to PC 200B correlated with department B with which MFP 100B is also correlated, or a method of displaying the registration on panel 25 of MFP 100B as shown in FIG. 7 (step S311). It is to be noted that, as for the notification described above, preferably, information for notification of a fact that the document data is registered and a component for issuing a command to print out the document data (a button for issuing a command of printout in FIG. 7) are notified as shown in FIG. 7. With this configuration, the user of department B which has received the notification can issue the command to print out the document data with the use of this notification.

Box control unit 109 allows the box which is the designated registration destination to store the designated document data (step S313). It is to be noted that if box control unit 109 determines that the billing management box is not designated as the registration destination, that is, a normal box is designated as the registration destination in step S301 (NO in step S301), then, the processes in steps S303 to S311 are not executed, but only the process of storing the document data in the box designated in step S313 is executed.

FIG. 6 shows the processes described above as one specific example. The process of storing the document data in the billing management box in step S313 may be executed prior to the notifying process in steps S309 and S311. In other words, the document data is stored in the billing management box, and then the notifying process in steps S309 and S311 may be executed. Moreover, none of the process of setting the upper limit number of sheets of paper to be printed as the upper limit value counter in steps S305 and S307 and the notifying process in steps S309 and S311 may be executed. Alternatively, only one of the foregoing processes may be executed. Moreover, the processing order is not limited to the example shown in FIG. 6, and may be changed. In addition, theses processes may be executed by default even when department A which has made registration issues no command, that is, may be executed by default without execution of the determination in step S305 and the determination in step S309. For example, the number of sheets of paper set by default as the upper limit number of sheets of paper may be set automatically. Moreover, the notification may be automatically sent to MFP 100B including the registered billing management box and PC 200B allocated to identical department B. These variations can be adopted similarly in a document data registering process according to a second embodiment (to be described later).

Figure 8:
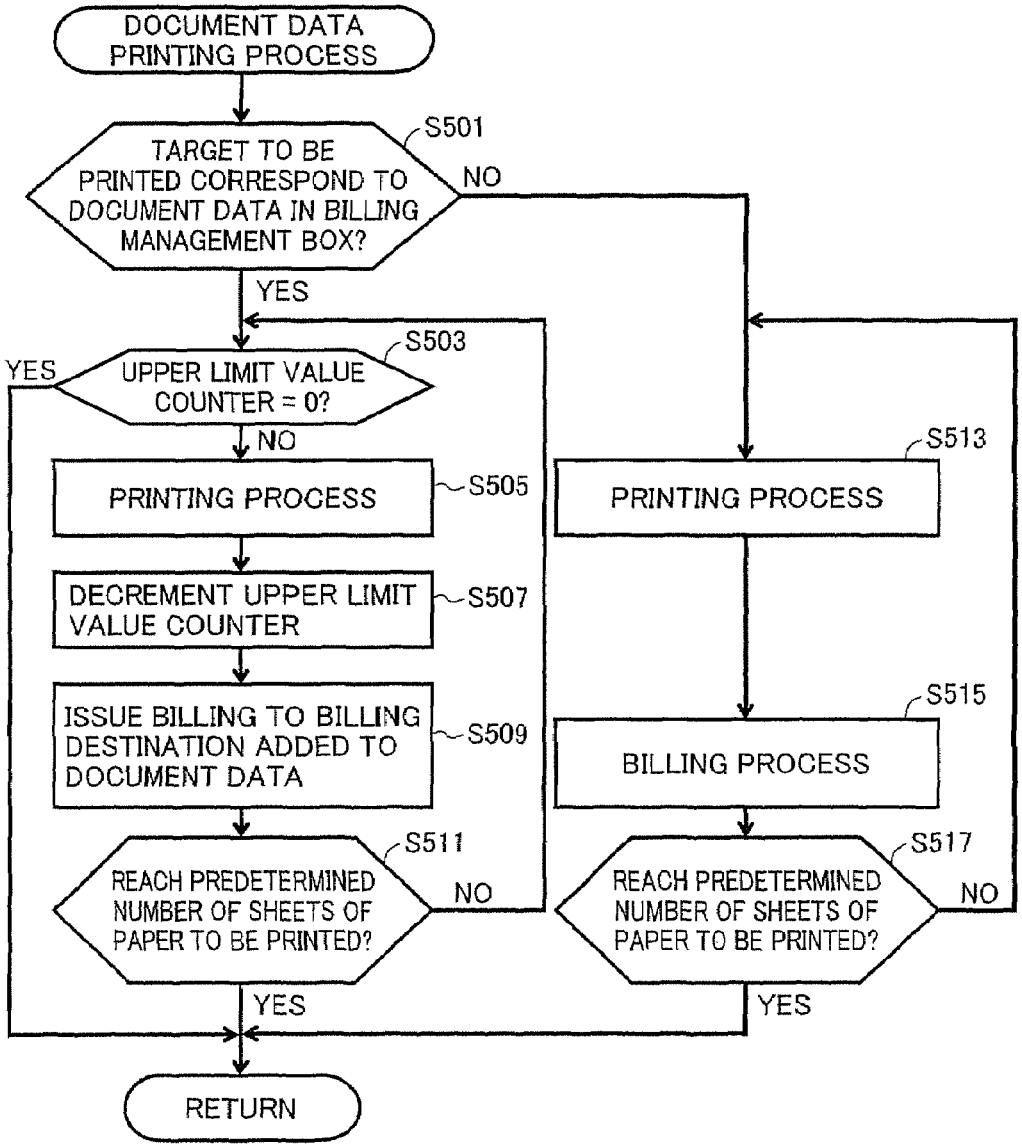
FIG. 8 is a flowchart showing a specific example of a document data printing process according to the first embodiment.

FIG. 8 is a flowchart showing a specific example of the document data printing process in step S50 according to the first embodiment. Specifically, it is assumed herein that MFP 100B prints out the document data registered in the box in MFP 100B by the document data registering process described above.

With reference to FIG. 8, box control unit 109 of MFP 100B analyzes a command signal received newly, and determines whether or not the billing management box is designated as a place in which document data to be printed out is stored (step S501). For example, when the document data to be printed out is designated with the use of PC 200B or panel 25 of MFP 100B, information for specifying the document data and a pass to the memory area in which the document data is stored are contained in the command signal containing a command of a request to print out the document data. In a case where the box is the billing box, as described earlier, box control unit 109 stores, as the information about the box, an identifier indicating a fact that the relevant box is the billing management box. With regard to the box storing the document data represented by the received command signal, therefore, box control unit 109 determines whether or not the identifier is stored as the information about the box to determine whether or not the designated box is the billing management box described above.

If box control unit 109 determines that the document data to be printed out is stored in the billing management box (YES in step S501), then, upper limit management control unit 113 examines whether or nor the upper limit value counter added to the relevant document data is zero. If the upper limit value counter is not zero (NO in step S503), then, image processing control unit 101 executes the image processing for printing out the relevant document data and, thereafter, overall control unit 117 executes the process of outputting the relevant document data on one sheet of paper (step S505). Thereafter, upper limit management control unit 113 decrements the upper limit value counter added to the relevant document data by one (step S507). As described earlier, moreover, billing management control unit 111 stores the department ID of the department correlated with each MFP 100 included in this system. Therefore, billing management control unit 111 reads billing destination information added to the relevant document data, and issues billing to MFP 100A correlated with department A which is specified as a billing destination by the billing destination information and issues a command to register the relevant document data (step S509).

Each time the relevant document data is outputted onto one sheet of paper by execution of the processes in steps S505 to S509, overall control unit 117 examines whether of not the printing process is executed by the number of sheets of paper designated by the received command signal (step S511). If overall control unit 117 determines that the printing process is not completed yet (NO in step S511), then, the processes in step S503 and subsequent to step S503 are executed repeatedly until the document data is outputted to the designated number of sheets of paper. When the processes described above are executed repeatedly, upper limit management control unit 113 examines whether or not the upper limit counter added to the relevant document data reaches zero in step S503. Therefore, the number of sheets of paper reaches the upper limit number of sheets of paper set to the relevant document data in the course of the designated number of sheets of paper (YES in step S503), the processing is completed without execution of the remaining printing process.

If box control unit 109 determines that the document data to be printed out is not stored in the billing management box, that is, the document data to be printed out is stored in the normal box (NO in step S501), then, overall control unit 117 executes the normal printing process until the number of printed sheets of paper reaches the designated number of sheets of paper to be printed (steps S513, S517), and billing management control unit 111 increments the billing counter of MFP 100B, that is, executes the normal billing process (step S515).

By execution of the document data registering process and document data printing process according to the first embodiment, as in the specific example described above, in a case where department A such as a general affairs department creates document data such as a communication document and, then, issues a request to print out the document data to department B such as a sales department, when the document data is printed out with the use of MFP 100B allocated to the sales department, billing is not issued to the sales department which issues a command of printout of the document data, but is issued to the general affairs department which issues a command of registration of the document data. Thus, fairness of the billing is ensured. Moreover, in a case where department A such as the general affairs department issues a request to print out the document data to department B such as another department, only when department A performs an operation of registering the created document data in the billing management box of MFP 100B allocated to department B, department A which has issued the command to register the relevant document data is automatically set as the billing destination. Therefore, department A readily performs an operation for issuing the request of printing. Moreover, the upper limit number of sheets of paper to be printed can be set at the time of registration. This configuration is allowed to prevent the document data from being outputted onto sheets of paper the number of which is not desired by department A, in department B corresponding to another department which has issued the request of printing, and to prevent undesired billing from being issued to department A. Moreover, a setting can be made such that the registration of the relevant document data is notified to department B at the time of the registration. With this configuration, department A can readily issue the request of printing to department B.

Second Embodiment

Figure 9:
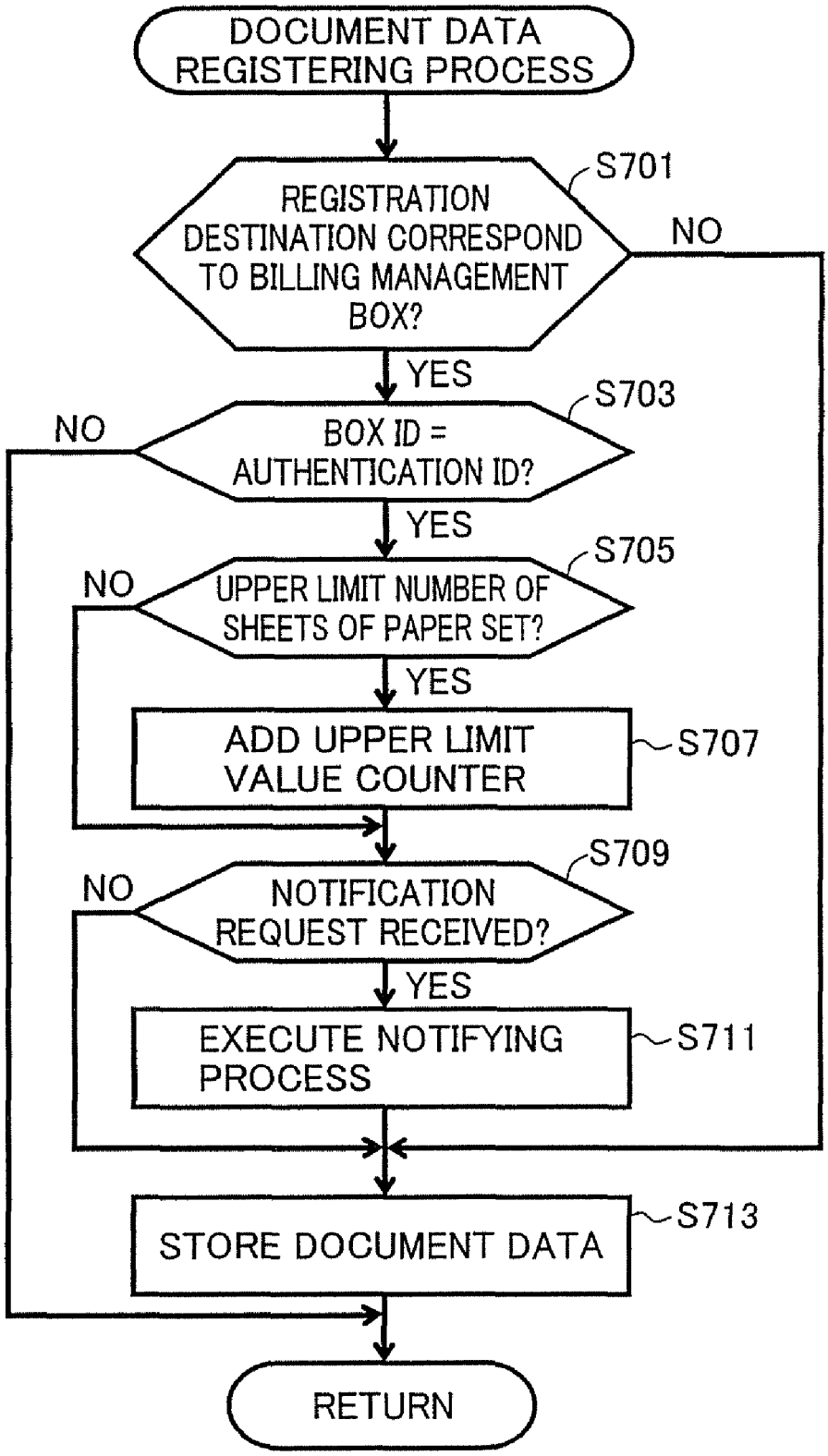
FIG. 9 is a flowchart showing a specific example of a document data registering process according to a second embodiment.

FIG. 9 is a flowchart showing a specific example of a document data registering process in step S30 according to a second embodiment. As in the first embodiment, specifically, it is also assumed herein that one of MFP 100A and PC 200A allocated to department A or MFP 100B allocated to department B is operated to register document data in the box in MFP 100B.

In the second embodiment, memory unit 20 of MFP 100 includes a billing management box correlated with each department as the billing department box. Box control unit 109 stores, as information about the box of the billing management box, an identifier indicating that the relevant box is the billing management box, and a department ID of the correlated department.

With reference to FIG. 9, box control unit 109 of MFP 100B analyzes a command signal received newly, and determines whether or not the box designated as a document data registration destination is the billing management box described above (step S701). The determining process executed herein is similar to that in step S301 according to the first embodiment.

If box control unit 109 determines that the billing management box is designated as the registration destination (YES in step S701), then, box control unit 109 acquires the department ID of department A as authentication information used for authentication in step S20 from department authentication control unit 115, and compares this department ID with the department ID of the department correlated with the billing management box designated as the registration destination (step S703). As a result of the comparison, if box control unit 109 determines that these department IDs match (YES in step S703), that is, if box control unit 109 determines that department A issues a command to register the document data in the billing management box of MFP 100B correlated with department A, then, processes in steps S705 to S711 are executed and, thereafter, the document data is registered in the billing management box, which is designated by department A, of MFP 100B correlated with department A in step S703. The processes in steps S705 to S711 are similar to those in steps S305 to S311 described in the first embodiment.

As a result of the comparison, if box control unit 109 determines that these department IDs do not match (NO in step S703), that is, if box control unit 109 determines that department A issues the command to register the document data in the billing management box of MFP 100B correlated with a department different from department A, then, the routine is completed without execution of the subsequent processes.

FIG. 9 shows the foregoing processes as one specific example. If box control unit 109 determines that the department ID serving as the authentication information used for authentication in step S302 does not match with the department ID of the department correlated with the billing management box designated as the registration destination (NO in step S703), that is, if box control unit 109 determines that department A issues the command to register the document data in the billing management box of MFP 100B correlated with the department different from department A, then, box control unit 109 may specify the billing management box correlated with department A from among the billing management boxes included in memory unit 20 on the basis of the department ID of department A serving as the authentication information. Then, the subsequent registering process may be executed on the relevant billing management box.

In the case of the configuration of memory unit 20 of MFP 100 in the second embodiment, further, the command of the request to register the document data may be a command of only a request to register the document data in a billing management box without specifying that the relevant billing management box is correlated with which department. In this case, as in the manner described above, box control unit 109 may specify the billing management box correlated with department A from among the billing management boxes included in memory unit 20 on the basis of the department ID of department A serving as the authentication information. Then, the subsequent registering process may be executed on the relevant billing management box.

Figure 10:
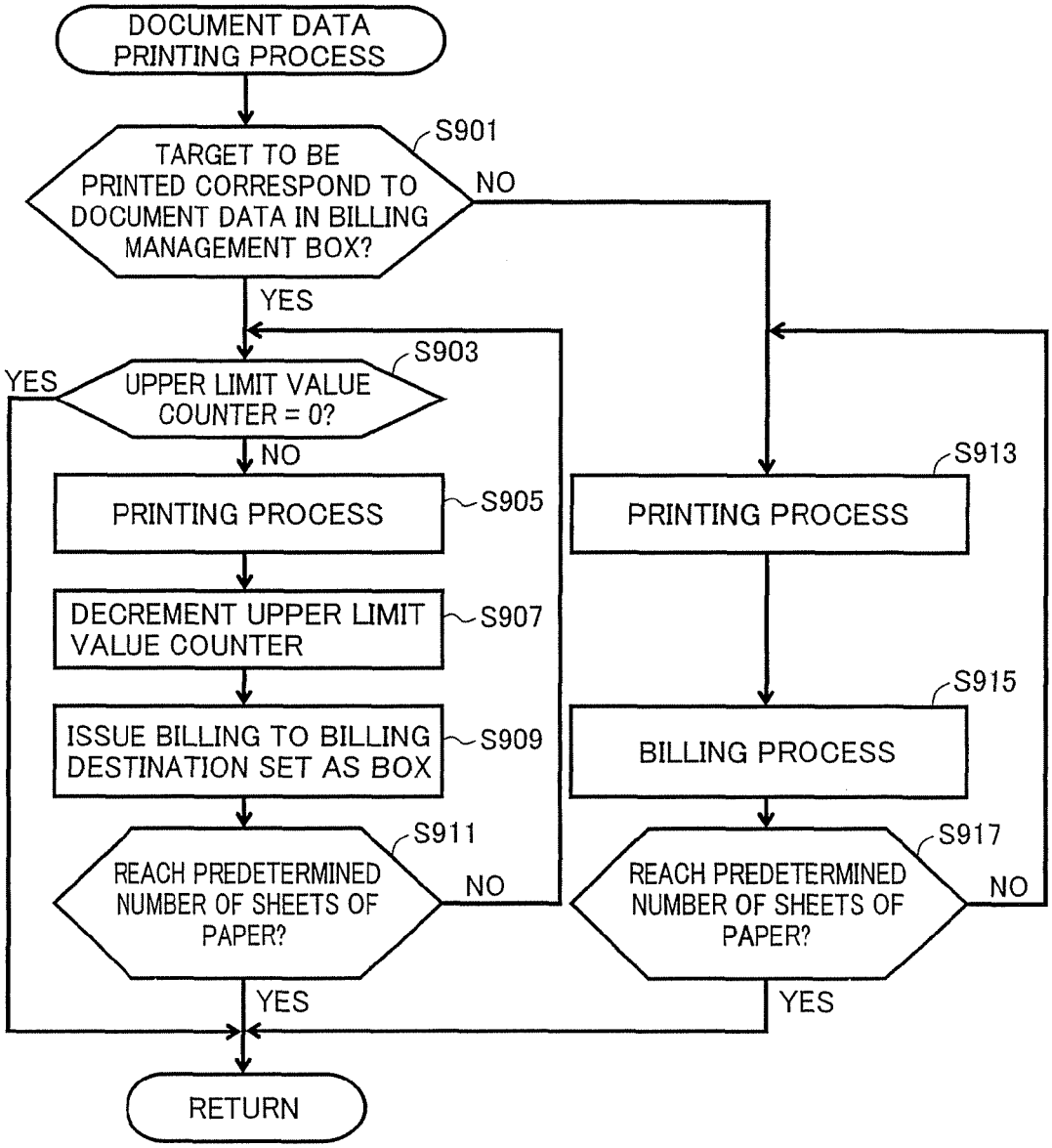
FIG. 10 is a flowchart showing a specific example of a document data printing process according to the second embodiment.

FIG. 10 is a flowchart showing a specific example of a document data printing process in step S50 according to the second embodiment. As in the first embodiment, specifically, it is also assumed herein that document data registered in the box in MFP 100B is printed out in MFP 100B by execution of the document data registering process described above.

With reference to FIG. 10, in the document data printing process according to the second embodiment, processes in steps S901 to S907 are similar to those in steps S501 to D507 in the document data printing process according to the first embodiment. That is, if department B issues a command to designate and print out document data stored in the billing management box correlated with department A (YES in step S901), then, printing processes are executed on the relevant document data in steps S903 to S907 as in the processes in steps S503 to S507 and, thereafter, the billing process according to the second embodiment is executed in step S909. As described earlier, billing management control unit 111 stores a department ID of a department correlated with each MFP 100 included in this system. Moreover, box control unit 109 stores a department ID of a department correlated with a billing department box. Therefore, when the designated document data is outputted onto one sheet of paper in steps S903 to S907, then, billing management control unit 111 acquires the department ID of department A correlated with the billing management box in which the relevant document data is stored, from box control unit 109, and issues billing to MFP 100A correlated with department A (step S909). It is noted that if box control unit 109 determines that the document data to be printed out is not stored in the billing management box, that is, the document data to be printed out is stored in the normal box (NO in step S901), then, the normal printing process and the normal billing process similar to those in steps S513 to S517 according to the first embodiment are executed in step S913 to S917.

By execution of the document data registering process and the document data printing process according to the second embodiment, in the case where the department A such as a general affairs department issues the request to print out the document data to department B which is another department, department A performs the operation of registering the created document data in the billing management box correlated with department A from among the billing management boxes in MFP 100B allocated to department B, so that billing is automatically issued to department A at the time when the relevant document data is printed out in MFP 100B. Alternatively, department A issues a command to register the document data in the billing management box of MFP 100B allocated to department B, so that the document data can be automatically registered in the billing management box correlated with department A, from among the billing management boxes in MFP 100B. As a result, billing is automatically issued to department A at the time when the relevant document data is printed out in MFP 100B. Therefore, department A readily performs the operation at the time of issuing the request of printing.

(Modification 1)

It is to be noted that, in the foregoing specific examples, the upper limit number of sheets of paper to be printed is set as the upper limit value at the document data; however, the information to be set herein is not limited to the upper limit number of sheets of paper to be printed. For example, any other information may be set as long as it is information for restricting a printing operation concerning billing. Alternatively, another information may be combined. A specific example of such another information may include a size of a sheet of paper to be printed. In this case, CPU 10 of MFP 100 further includes, as a control structure, a control unit that examines and controls the restriction to the printing operation as in upper limit management control unit 113. Then, the control unit examines whether or not a command of printout satisfies the restriction to the printing operation added to the document data at the time when the printing operation is performed in MFP 100B. In the case where department A issues the request to print out the document data to department B, the addition of the information for restricting the printing operation to the document data can minutely prevent an undesired printing operation for department A from being performed by department B.

(Modification 2)

In the foregoing specific examples, memory unit 20 of MFP 100 includes the billing management box, and only the document data, which is a target of printing to be requested to another department, is stored in the relevant billing management box by the document data registering process. However, the billing management box may store document data for issuing billing to a department specified by billing destination information or a department correlated with the relevant billing management box, together with document data for normal billing management. In this case, preferably, when box control unit 109 stores the relevant document data in the billing management box in step S313 or S713, a flag indicating a fact that such document data is document data for issuing billing to a department specified by billing destination information or a department correlated with the relevant billing management box is added to the relevant document data.

In the document data registering process according to the first embodiment, the billing destination information is added to the document data stored in the billing management box; therefore, billing management control unit 111 can determine that the document data having the billing destination information added thereto is document data for issuing billing to a department specified by the relevant billing destination information, at the time when the printing operation is performed. In the case of Modification 2 in the first embodiment, therefore, the flag described above is not essential. In the document data registering process according to the second embodiment, on the other hand, no billing destination information is added to the document data stored in the billing management box. At the time when the printing operation is performed, billing management control unit 111 issues billing to a department correlated with the billing management box having the document data stored therein in step S909. In the case of Modification 2 in the second embodiment, accordingly, the flag described above becomes essential.

In the case of Modification 2 in the first embodiment, further, memory unit 20 of MFP 100 may include the billing management box and the normal box without distinction. In this case, at the time when the printing process is performed, box control unit 109 determines whether or not the flag is added to the document data to be printed out or determines whether or not the billing destination information is added to the document data to be printed out in step S501. If such information is added, the processes in step S503 and subsequent to step S503 are executed.

(Modification 3)

In the foregoing examples, each MFP 100 stores information about each box included therein, a billing counter, and a department correlated with each MFP 100 included in this system. However, at least any of the information may be stored in server PC 300 and MFP 100 may read and acquire the information from server PC 300 if necessary. In the first embodiment, further, the billing destination information and the upper limit value counter are added to the document data. In the second embodiment, on the other hand, the upper limit value counter is added to the document data. Likewise, at least any of the information may be stored in server PC 300 and MFP 100 may read and acquire the information from server PC 300 if necessary.

In the foregoing examples, further, the box is included in memory unit 20 of MFP 100. However, the box may be included in server PC 300 or the memory unit of PC 200. In this case, preferably, department authentication is performed in the document data printing process in order to specify a department which performs a printing operation.

In the foregoing examples, further, the document data registering process and the document data printing process are executed in MFP 100. However, at least a part of the processes in the document data registering process or at least a part of the processes other than the printing process in the document data printing process may be executed in server PC 300 or PC 200.

(Modification 4)

In the case where this system configuration is a system configuration in an office environment or the like, further, an upper limit value of the number of sheets of paper to be printed, that is, the upper limit number of sheets of paper to be printed is set for each MFP 100 in some cases. As in the management of the upper limit number of sheets of paper onto which the document data is outputted, the upper limit value for MFP 100 can be managed in such a manner that upper limit management control unit 113 stores an upper limit counter for relevant MFP 100 and decrements a count thereof each time a printing operation is performed.

Figure 11:
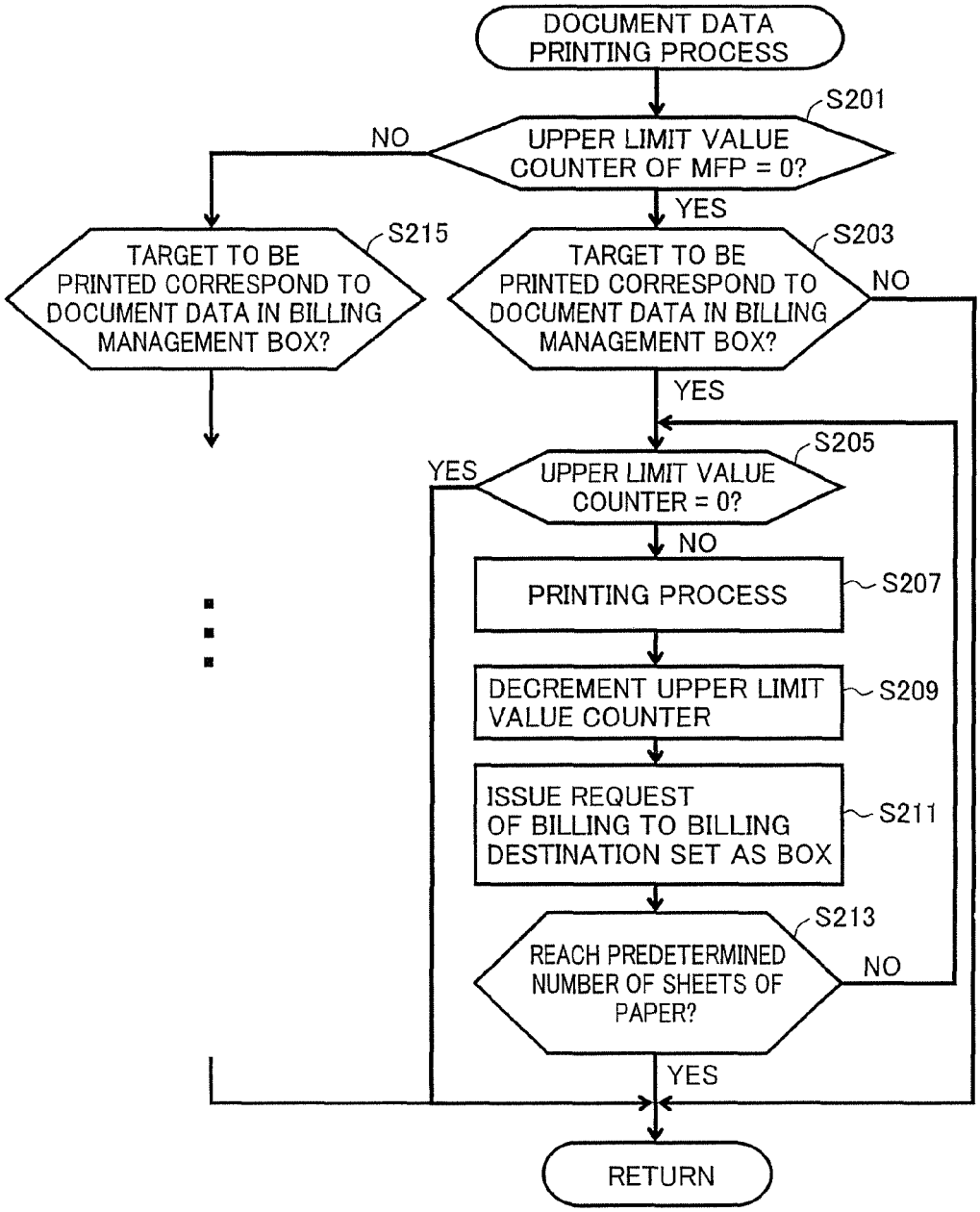
FIG. 11 is a flowchart showing a specific example of a document data printing process according to Modification 4.

FIG. 11 shows a document data printing process in this case. With reference to FIG. 11, if it is determined that each of the command signals inputted in steps S10 and S40 indicates a command of a request to print out the document data registered in the box, then, upper limit management control unit 113 of MFP 100B examines whether or not the upper limit value counter of the number of sheets of paper to be printed which is set for relevant MFP 100B storing the upper limit counter is zero (step S201). If the upper limit value counter of the number of sheets of paper to be printed which is set for relevant MFP 100B is not zero (NO in step S201), then, processes similar to the processes in steps S501 to S511 described in the first embodiment or processes similar to the document data printing process in the foregoing steps described in the second embodiment are executed in steps S203 to S213. With regard to the subsequent steps in the case where it is determined that the upper limit value counter is not zero in step S201, if the document data to be printed out is not document data in the billing management box, but is normal document data, that is, if NO in step S215 shown in FIG. 11, preferably, upper limit management control unit 113 decrements the upper limit value counter of the number of sheets of paper to be printed which is set for relevant MFP 100B, each time the document data is outputted onto one sheet of paper, and determines whether or not the upper limit value counter reaches zero. Preferably, when the upper limit value counter of the number of sheets of paper to be printed which is set for relevant MFP 100B reaches zero, then, the routine is completed without execution of the subsequent processes.

If the upper limit value counter of the number of sheets of paper to be printed which is set for relevant MFP 100B reaches zero (YES in step S201) and the document data to be printed out is not document data in the billing management box (NO in step S203), then, the routine is completed without execution of the subsequent printing processes.

On the other hand, if the document data to be printed out is document data in the billing management box (YES in step S203), that is, if the document data to be printed out is document data which is a target of printing requested by department A, for example, a general affairs department, then, overall control unit 117 executes the processes in step S205 and subsequent to step S205 on the designated document data even when upper limit management control unit 113 makes a determination as in step S200.

Even in a case where the number of sheets of paper to be printed which is set for relevant MFP 100B reaches its upper limit value, when document data printing process is executed as described above, the normal document data can not be printed out, but the document data which is a target of printing requested by department A, for example, a general administration part, can be printed out.

The present invention can also provide the foregoing program that allows an image forming apparatus such as MFP 100 and an information processing apparatus such as server PC 300 to execute the foregoing document data registering process and document data printing process. This program can be provided as a program product while being recorded in a computer-readable recording medium such as a flexible disk, a CD-ROM (Compact Disk-Read Only Memory), a ROM (Read Only Memory), a RAM (Random Access Memory) or a memory card accessorily provided in a computer. In addition, this program can be provided while being recorded in a recording medium such as a hard disk incorporated in a computer. Moreover, this program can be provided by download through a network.

It is to be noted that the program according to the present invention may execute a process so as to call necessary modules in a predetermined arrangement at a predetermined timing from among program modules provided as a part of an operating system (OS) in a computer. In this case, the program itself does not contain the modules, and executes a process in cooperation with the OS. Such a program which does not contain the modules may be also included in the program according to the present invention.

Moreover, the program according to the present invention may be provided while being incorporated as a part of another program. Also in this case, the program itself does not contain the modules contained in another program described above, and executes a process in cooperation with another program described above. Such a program incorporated into another program may also be included in the program according to the present invention.

A program product to be provided herein is executed while being installed on a program storage unit such as a hard disk. It is to be noted that the program product includes the program itself, and a recording medium having the program recorded therein.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An image forming apparatus comprising:

an input unit for document data;

a registration unit registering said document data in a predetermined memory area, said memory area being correlated with a department;

a print unit printing out said document data stored in said predetermined memory area;

a request unit issuing a request for billing to a specific department for the printout of said document data registered in said memory area, to a billing managing apparatus that manages billing for printout in each department, wherein said request designates said department correlated with said memory area as said specific department; and a notification unit to notify a separate image forming apparatus correlated with said department of a fact that said document data is registered in said memory area.

2. The image forming apparatus according to claim 1, further comprising an authentication unit authenticating a department that has issued a command to register said document data, wherein said request unit issues said request of billing to said department that has issued said command to register said document data with said department being designated as said specific department.

3. The image forming apparatus according to claim 2, wherein said registration unit sets and registers said department that has issued said command to register said document data as said specific department serving as a billing destination at said document data.

4. The image forming apparatus according to claim 1, wherein said department correlated with said image forming apparatus that performs the printing operation and said department issuing the command of registration are different from each other.

5. The image forming apparatus according to claim 1, wherein said registration unit includes a setting unit to set an upper limit of the number of sheets of paper to be printed at said document data, said image forming apparatus further comprising a restriction unit restricting the number of sheets of paper onto which said print unit outputs said document data, on the basis of said upper limit of the number of sheets of paper to be printed which is set at said document data.

6. The image forming apparatus according to claim 1, further comprising a display unit displaying a fact that said document data is registered in said memory area.

7. The image forming apparatus according to claim 1, further comprising:

a memory unit storing an upper limit value of the number of sheets of paper to be printed for each department; and a control unit controlling said print unit such that the number of sheets of paper to be printed for each department falls within said upper limit value, wherein when said document data is selected to be printed in said print unit, said control unit allows said print unit to print out said document data even in a case where the number of sheets of paper to be printed in said department that performs the printing operation reaches said upper limit value.

8. The image forming apparatus according to claim 1, further comprising:

an authentication unit comparing a first department identification used for authentication with a second department identification of a department correlated with a billing management box.

9. A billing management method in an image forming apparatus, comprising the steps of:

accepting a command to print out document data stored in a predetermined memory area that is correlated with a department;

notifying a separate image forming apparatus correlated with said department of a fact that said document data is stored in said memory area;

printing out said document data; and issuing a request of billing to a specific department designated as a place to which billing for the printout of said document data is issued, wherein said department correlated with said memory area is designated as said specific department.

10. The billing management method according to claim 9, wherein a department issuing a command to register said document data is set at the document data, and in said step of issuing the request, billing is issued to said document that has issued the command to register the document data with said department being set as said specific department.

11. The billing management method according to claim 9, wherein said department correlated with said image forming apparatus that prints out said document data in said step of printing and said department issuing a command to register said document data in said predetermined memory area are different from each other.

12. The billing management method according to claim 9, wherein an upper limit value of the number of sheets of paper to be printed is set at said document data, and in said step of printing, the printing of said document data is restricted on the basis of the upper limit value of said number of sheets of paper to be printed which is set at said document data.

13. The billing management method according to claim 9, wherein in said step of printing, when said document data is selected to be printed, said document data is printed out even in a case where the number of sheets of paper to be printed in said department that performs the printing operation reaches said upper limit value set for the department.

14. The billing management method according to claim 9, further comprising the step of:

comparing an identification for authenticating a department with a selected department identification correlated to a billing management box.

15. A billing management method in an image forming apparatus, comprising the steps of:

accepting a command to register document data in a predetermined memory area, said memory area being correlated with a department;

authenticating a department that issues said command;

setting information indicating said department as a place to which billing for printout is issued at said document data, and registering said document data in said memory area; and when said document data is registered in said memory area, notifying a separate image forming apparatus correlated with said department of a fact that said document data is registered in said memory area.

16. The billing management method according to claim 15, wherein in said step of setting the information, further, an upper limit value of the number of sheets of paper to be printed is set at said document data.

17. The billing management method according to claim 15, further comprising a step of, when said document data is registered in said memory area, displaying a fact that said document data is registered in said memory area on a display unit of an image forming apparatus having said memory area.

18. The billing management method according to claim 15, further comprising the step of:

comparing an identification for authenticating a department with a selected department identification correlated to a billing management box.

19. An image forming apparatus comprising:

an input unit for document data;

a memory having a plurality of memory areas, each memory area being correlated with a respective one of a plurality of departments;

a registration unit registering said document data in the memory area which is correlated with one of the plurality of departments;

a print unit printing out said document data stored in said memory area;

a request unit issuing a request of billing to said one of the plurality departments correlated with the memory area for the printout of said document data registered in said memory area, to a billing managing apparatus that manages billing for printout in each department.

* * * * *